US005174102A

United States Patent [19]

Matsui et al.

[11] Patent Number: 5,174,102

[45] Date of Patent: Dec. 29, 1992

[54] TWIST NUMBER SETTING DEVICE FOR A TWO-FOR-ONE TWISTER

[75] Inventors: Isamu Matsui, Kyoto; Yutaka Ueda, Nara, both of Japan

[73] Assignee: Murata Kikai Kabushiki Kaisha, Kyoto, Japan

[21] Appl. No.: 710,260

[22] Filed: Jun. 4, 1991

Related U.S. Application Data

[60] Continuation of Ser. No. 467,992, Jan. 22, 1990, abandoned, which is a division of Ser. No. 190,573, May 5, 1988, abandoned.

[30] Foreign Application Priority Data

May 9, 1987 [JP] Japan ..... 62-113172
Jan. 27, 1988 [JP] Japan ..... 63-16147

[51] Int. Cl.[5] ..... D01H 1/30; D01H 1/26

[52] U.S. Cl. ..... 57/264; 57/94; 57/100

[58] Field of Search ..... 57/92-94, 57/100, 264

[56] References Cited

U.S. PATENT DOCUMENTS

| | | | |
|---|---|---|---|
| 3,943,689 | 3/1976 | Kunz et al. | 57/93 X |
| 3,986,330 | 10/1976 | Kuttruff et al. | 57/94 |
| 4,102,117 | 7/1978 | Dornberger | 57/93 |
| 4,519,202 | 5/1985 | Hausner et al. | 57/93 |
| 4,922,703 | 5/1990 | Matsui et al. | 57/264 X |

*Primary Examiner*—Daniel P. Stodola
*Assistant Examiner*—William Stryjewski
*Attorney, Agent, or Firm*—Spensley Horn Jubas & Lubitz

[57] ABSTRACT

A twist number setting device for a two-for-one twister constituted such that an output power shaft of a drive motor is connected to a drive pulley which is connected to a spindle and provides a turning force to the spindle and also connected to a rotary shaft of a drum which contacts with a winding package and provides a turning force to the package, and a speed change mechanism is interposed between the output power shaft of the drive motor and the rotary shaft of the drum.

7 Claims, 4 Drawing Sheets

TWIST NUMBER SETTING DEVICE FOR A TWO-FOR-ONE TWISTER

This is a continuation of application Ser. No. 07,467,992 filed on Jan. 22, 1990, now abandoned, which is a division of application Ser. No. 07,190,573, filed on May 5, 1988, now abandoned.

FIELD OF THE INVENTION AND RELATED ART STATEMENT

This invention relates to a two-for-one twister.

A two-for-one twister is constituted such that, as already known, yarn released from a yarn supply package is introduced into a central hole of a spindle and then a tensile force is applied to the yarn suitably by a tension device whereafter twist is applied to the yarn while the yarn is being ballooned by a rotating rotary disk and then the yarn is wound onto a winding package. The rotary disk is securely mounted on the spindle, and two twists are provided to the yarn by one full rotation of the spindle. In particular, the number of twists per one meter is represented by the following expression:

$$\text{Number of Twists} = \frac{\text{Spindle Rotations (rpm)} \times 2}{\text{Yarn Speed (m/min)}}$$

It is to be noted that the yarn speed in the expression above is a speed at which yarn is wound onto a winding package.

By the way, the number of twists may be changed depending upon the type or thickness of yarn to be supplied and is sometimes re-set before the two-for-one twister starts its operation because the twist may be applied hard or softly to yarn ( hightwist yarn or low twist yarn) even where the yarn is of the same type. Particularly, in recent years, multi-product small-quantity production has been recited also in the twisting field similarly as in many other fields, and the frequency of changing the number of twists has progressively increased.

Here, the structure of a driving mechanism for a conventional two-for-one twister is described briefly. A large number of juxtaposed spindles of a two-for-one twister are driven to rotate by an endless belt which travels along the spindles. The endless belt extends between a pair of pulleys, and an output power shaft of a drive motor is connected to one of the pulleys while a following turning force of a rotary shaft of the other pulley is utilized as a turning force for winding packages. In particular, the single drive motor serves as a motor for rotating the spindles and also as a motor for rotating the winding packages. The arrangement is employed for an economical object of minimizing the power consumption by provision of the single motor.

In the two-for-one twister having such a construction as described above, the output power shaft of the drive motor and rotary shafts of drums which are contacted with winding packages to transmit a turning driving force to the packages are connected to each other by way of several gears, and when the number of twists is to be re-set, some of the gears are conventionally exchanged to change the gear ratio in order to change the rotational speed of the drums. In particular, because the single driving source is provided, if the number of rotations of the drive motor is changed with an intention to change the number of rotation of the drums, the number of rotations of the spindles is changed correspondingly, and consequently the number of twists will not be changed. For example, if the number of rotations of the drive motor is doubled in order to double the number of rotations of the drums, then the number of rotations of the spindles will be doubled, and accordingly the number of twists will not be changed depending upon the expression specified hereinabove.

However, such a change of the number of twists by exchanging of gears as described hereinabove has problems that it is cumbersome and dirty to exchange gears and that an analogous gear may be used in error so that a desired number of twists cannot be obtained. Besides, it has another problem that much time is required for such exchanging of gears and hence the number of twists cannot be changed rapidly so that it is difficult to cope with such multi-product small-quantity production.

OBJECT AND SUMMARY OF THE INVENTION

It is an object of the present invention to provide a two-for-one twister in which a number of twists applied to a yarn processed can be changed rapidly without requiring much time.

According to the present invention, a twist number setting device for a two-for-one twister is constituted such that an output power shaft of a drive motor is connected to a drive pulley which is connected to a spindle and provides a turning force to the spindle and also connected to a rotary shaft of a drum which contacts with a winding package and provides a turning force to the package, and a speed change means is interposed between the output power shaft of the drive motor and the rotary shaft of the drum.

DETAILED DESCRIPTION OF PREFERRED EMBODIMENTS

Figure 1:
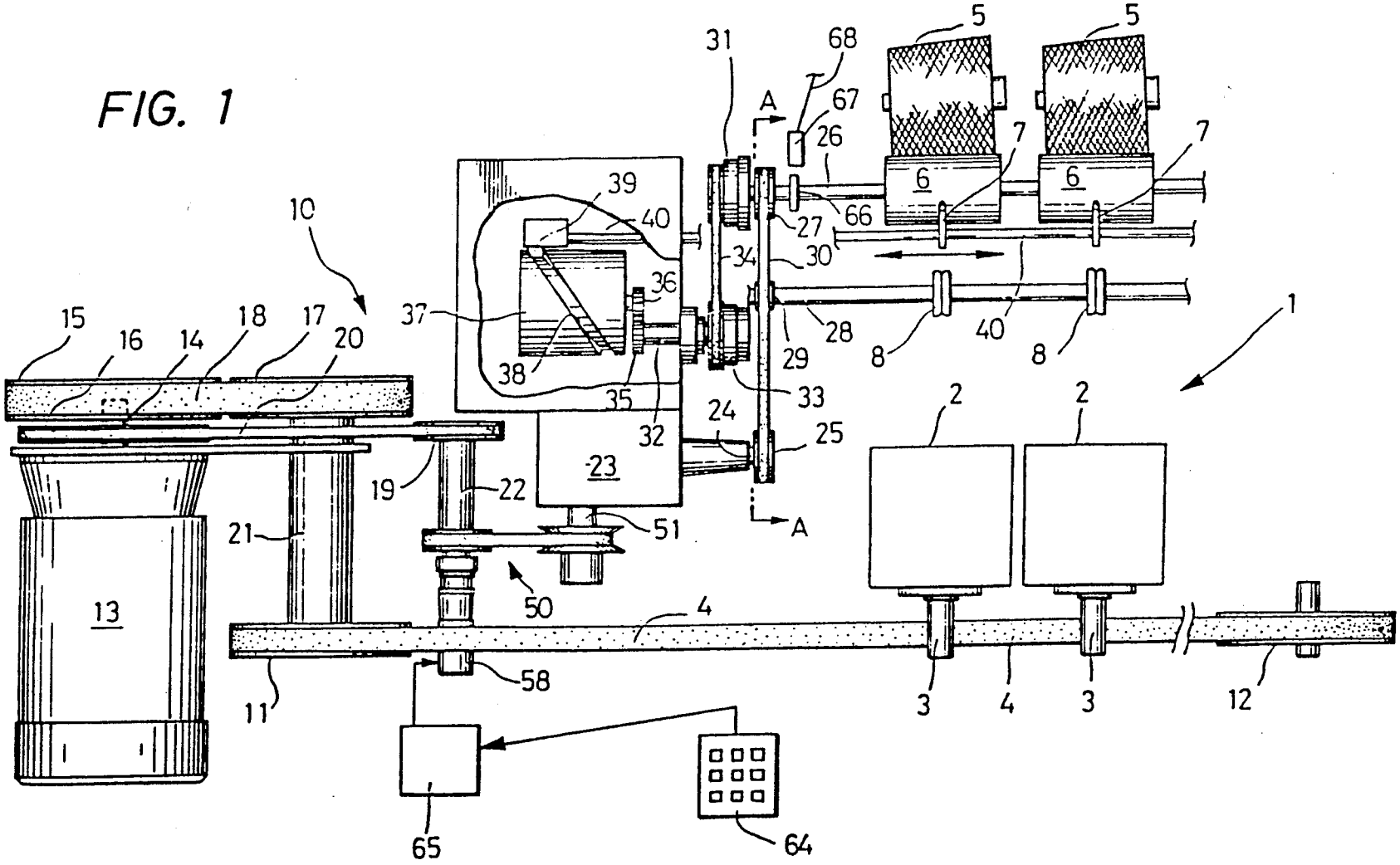
FIG. 1 is a front elevational view showing a two-for-one twister according to the present invention and a driving mechanism for the two-for-one twister, FIG. 2 a front elevational view showing a speed change belt device, FIG. 3 a sectional view taken along line A—A of FIG. 1, FIG. 4 a block diagram showing the structure of the inside of a control board, FIG. 5 a schematic view illustrating a signal detected at a sensor and a signal outputted from a one-fourth frequency divider, and FIG. 6 a flow chart illustrating contents of control in the control board.

FIG. 1 shows a two-for-one twister according to the present invention and a driving mechanism for the two-for-one twister. The two-for-one twister 1 includes a plurality of spindles arranged in a juxtaposed relationship. Reference numeral 2 denotes a cover for a yarn supply package, and yarn supply packages are placed in the covers 2. Reference numeral 3 denotes a spindle which is held in contact with a traveling belt 4. A winding package 5 is pressed against a positively rotating drum 6 so that a turning force is applied to the winding package 5 from the drum 6. Reference numeral 7 denotes a traverse guide, and 8 a feed roller.

Subsequently, the driving mechanism 10 will be described. The endless belt 4 extends between and around a pair of first and second pulleys 11 and 12. Reference numeral 13 denotes a drive motor, and a pair of third and fourth pulleys 15 and 16 are securely mounted on an output power shaft 14 of the motor 13. A belt 18 extends between and around the third pulley 15 and a fifth pulley 17 while another belt 20 extends between and around the other fourth pulley 16 and a sixth pulley 19. The first pulley 11 and the fifth pulley 17 are securely mounted at the opposite ends of a shaft 21. Thus, the output power of the drive motor 13 is transmitted to the traveling belt 4 via the output power shaft 14, third pulley 15, belt 18, fifth pulley 17 and first pulley 11, and as the belt 4 thus travels, the spindles 3 are rotated by the belt 4.

The sixth pulley 19 is securely mounted at one end of a shaft 22 the other end of which is connected to a speed change belt device 50 which will be hereinafter described. Reference numeral 23 denotes a speed reduction box in which a plurality of gear wheels are installed. The speed reduction box 23 receives a turning force from an output power shaft 51 of the speed reduction belt device 50 and reduces the speed of the rotation at a fixed rate while at the same time changing the axis of rotates.

Figure 3:
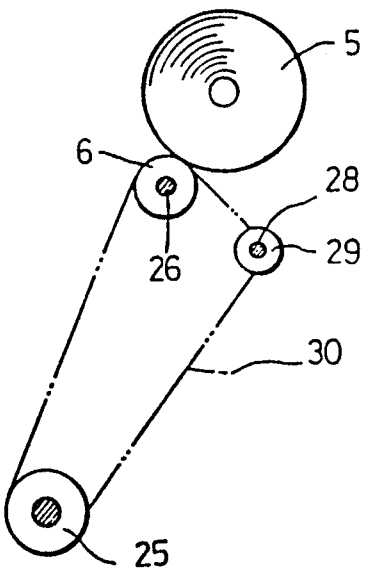

A seventh pulley 25 is securely mounted on an output power shaft 24 of the speed reduction box 23. A belt 30 extends between and around the seventh pulley 25, an eighth pulley 27 securely mounted on a support shaft 26 and a ninth pulley 29 securely mounted on another support shaft 28 as shown in FIG. 3. The drums 6 are securely mounted in a predetermined spaced relationship from each other on the support shaft 26, and a triple pulley 31 is securely mounted at one end of the support shaft 26. Meanwhile, the feed rollers 8 are securely mounted in a predetermined spaced relationship from each other on the support shaft 28.

A belt 34 extends between and around the triple pulley 31 and another triple pulley 33 securely mounted at one end of a shaft 32. The other end of the shaft 32 is connected to a groove drum 37 by way of a pair of gears 35 and 36. The drum 37 has a cam groove 38 formed thereon, and a cam shoe 39 is fitted in the cam groove 38. A reciprocating rod 40 is securely mounted on the cam shoe 39, and the traverse guides 7 are securely mounted in a predetermined spaced relationship from each other on the rod 40. With the construction described above, the output power of the drive motor 13 is transmitted via the belt 20, speed change belt device 50, speed reduction box 23 and belt 30 to the support shafts 26 and 28 for the drums 6 and the feed rollers 8 to rotate the drums 6 and the feed rollers 8, respectively.

Meanwhile, rotation of the support shaft 26 is transmitted via the belt 34 to the groove drum 37 to rotate the drum 37, and as the drum 37 rotates, the cam shoe 39 moves along the groove 38 thereby to reciprocally move the traverse guides 7.

Figure 2:
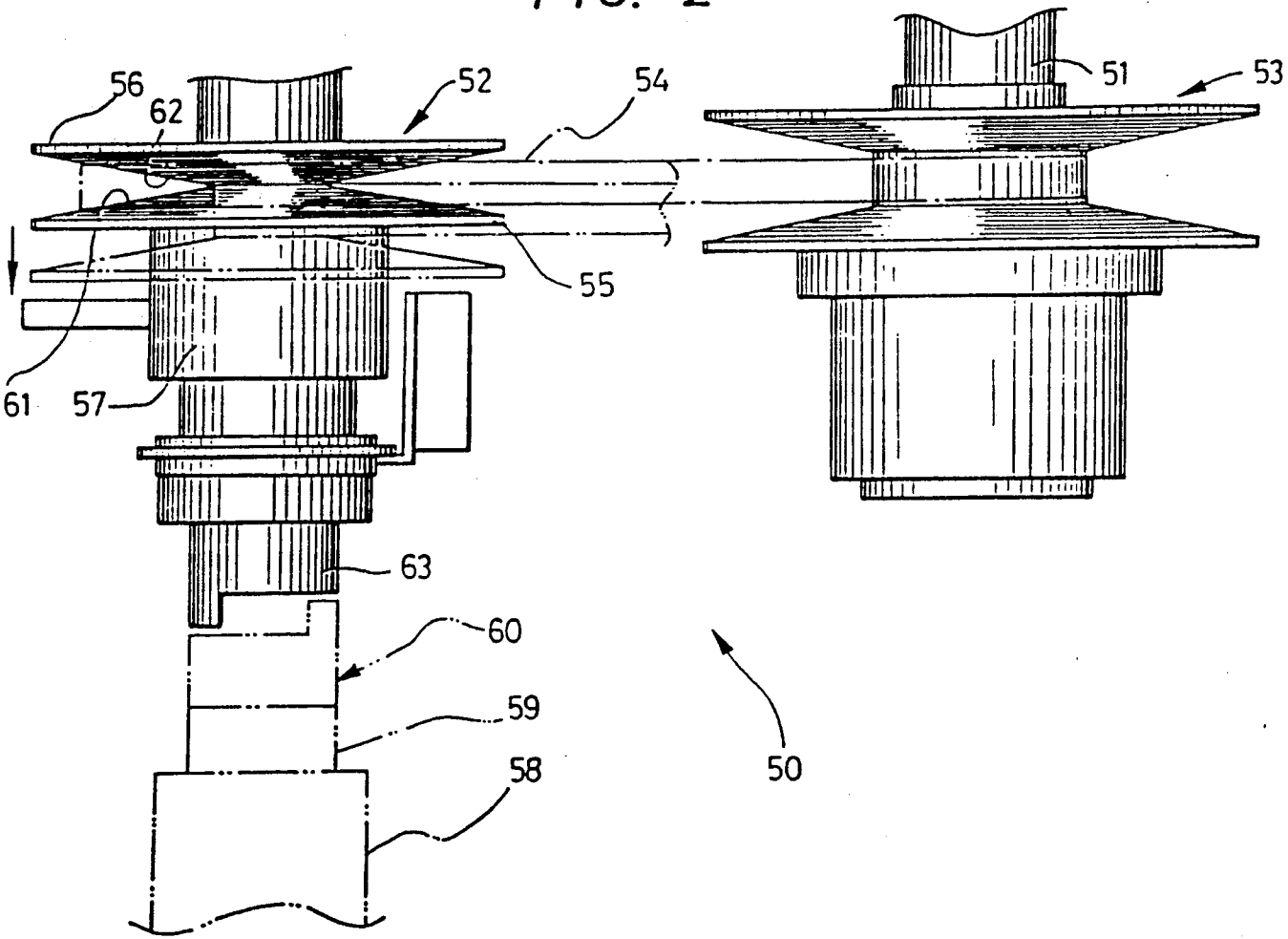

Subsequently, the speed change belt device 50 will be described with reference to FIG. 2. A belt 54 extends between an input side pulley 52 and an output side pulley 53. The input side pulley 52 is constituted from a pair of outer and inner washers 55 and 56, and a holder 57 is securely mounted on the outer washer 55. An output power shaft 59 of a control motor 58 is connected to the holder 57 by way of a clutch 60 so that, as the motor 58 operates, the outer washer 55 is moved in the direction of the shaft 59 relative to the inner washer 56. The inner washer 56 is stationary. The inner sides of the washers 55 and 56 are tapered as at 61 and 62 so that the positions at which the belt 54 engages with the washers 55 and 56 vary depending upon the distance between the washers 55 and 56. In particular, when the distance is small, the belt 54 engages with the washers 55 and 56 at portions near outer peripheries of the latter and hence the diameter of the passage of the belt 54 around the input side pulley 52 is great. On the contrary, when the distance is great, the belt 54 engages with the washers 55 and 56 at portions near minimum diameter portions of the latter and hence the diameter of the passage of the belt 54 around the input side pulley 52 is small. In this manner, it is possible to change the speed of rotation of the output from the output power shaft 51 of the output side pulley 53 by operation of the control motor 58 to change the diameter of the passage of the belt 54 around the input side pulley 52. The clutch 60 enables selective connection and disconnection between the output power shaft 59 of the motor 58 and a shaft 63.

When the control motor 58 is to operate, the clutch 60 is put into its connecting condition, and when the drive motor 13 is to operate, the clutch 60 is put into its disconnecting condition.

When it is necessary to change the number of twists before the two-for-one twister 1 is rendered operative, a value T of a desired number of twists is inputted by means of an input board 64 shown in FIG. 1. The input value to the input board 64 is inputted to a control board 65. In the control board 65, a yarn speed Y is determined from the twist number T and a number S of rotations of the spindles in accordance with a following expression:

$$Y = \frac{2S}{T}$$

After determination of the yarn speed Y, the output of the control motor 58 for the speed change belt device 50 is controlled in order to obtain such a speed change rate to obtain the yarn speed Y.

Referring to FIG. 1, a detected body 66 is securely mounted on the support shaft 26. The detected body 66 has a projection or a recess formed on a disk-formed circular portion thereof and is made of a conductive substance. Rotation of the detected body 66 is detected by a contactless sensor 67 to detect an actual number of rotations of the drums 6. In case the thus detected actual number of rotations of the drum does not coincide with a prescribed calculated value, the speed change belt device 50 is further operated to control until the two values coincide with each other. Output 68 of the sensor 67 is coupled to the control board 65. It is to be noted that the sensor 67 is not limited to a sensor of such a type wherein a contactless switch is employed as described above, and an optical sensor and so on may be utilized for the sensor 67.

Figure 4:
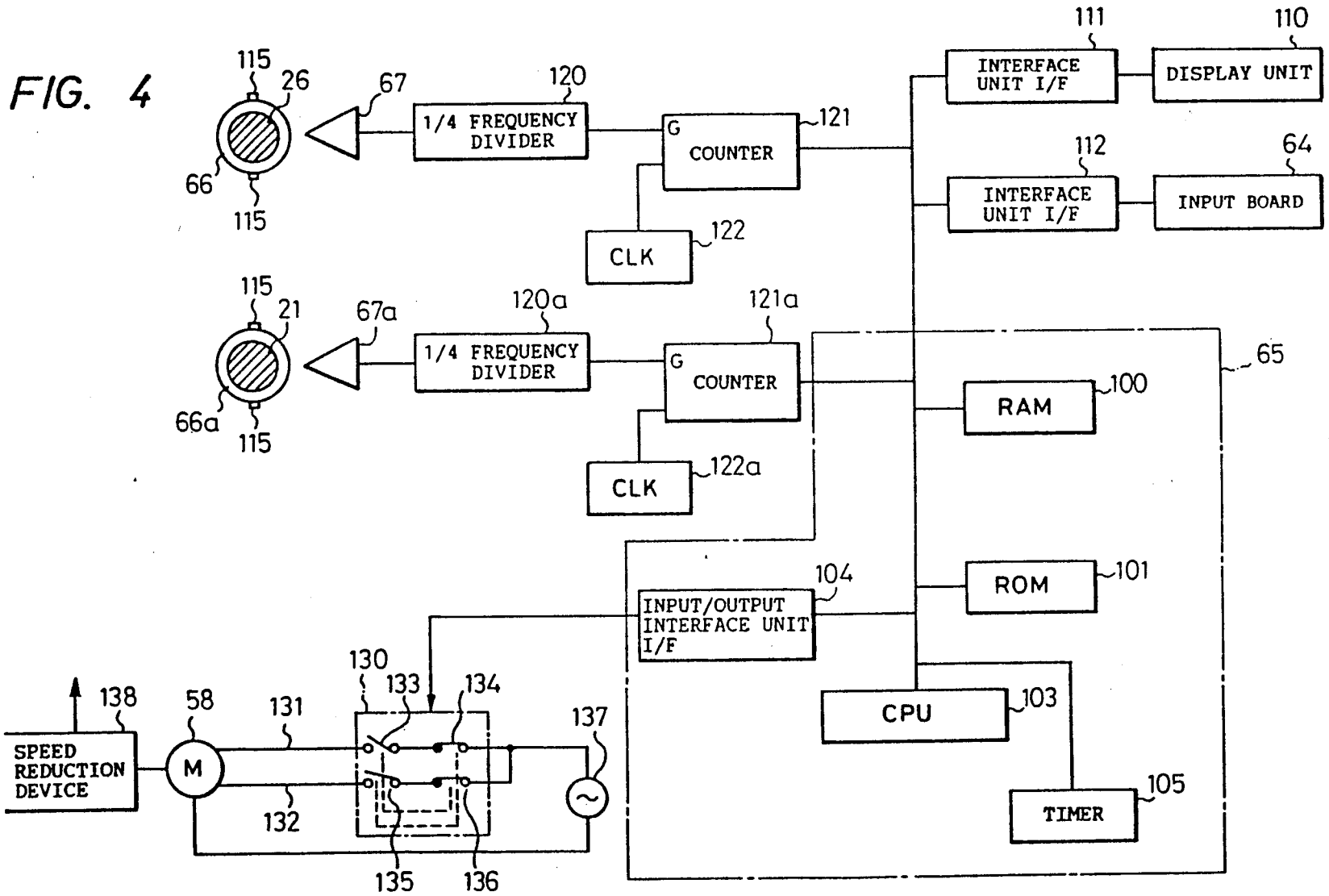
Figure 5:
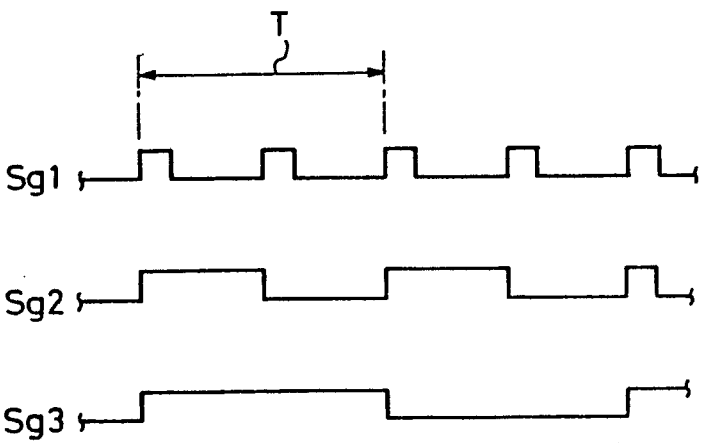

FIG. 4 shows, in block diagram, further details of the structure of the control board 65. The control board 65 is composed of a RAM (random access memory) 100, a ROM (read only memory) 101, a CPU (central processing unit) 103, an input/output interface unit 104 and a timer 105. The control board 65 receives the numbers of rotations of the support shaft 26 for the winding drums 6 and the support shaft 21 for the first pulley 11 and is connected to a display unit 110 and the input board 64 via a pair of interface units 111 and 112, respectively. A pair of rotors 66 and **66*a* each having a pair of teeth 115 at the diametrically opposite positions thereof are securely mounted on the support shafts 26 and 21, respectively, and are detected by a pair of contactless sensors 67 and 67***a*, respectively. Signals detected by the sensors 67 and 67*a* are transmitted to a pair of one-fourth frequency dividers 120 and 120*a*, respectively, and then to the control board 65 by way of to a pair of period measuring instruments 121 and 121*a*, respectively. At the one-fourth frequency dividers 120 and 120*a*, the frequency of the signals Sg1 detected by the sensors 67 and 67*a* is reduced to one-fourth Sg3 as illustrated in FIG. 5 which is outputted from the one-fourth frequency dividers 120 and 120*a*, respectively. It is to be noted that a signal Sg2 is shown having one half of the frequency of the signal Sgl. The ON time or the OFF time of the signal Sg3 corresponds to one cycle of rotation of the rotors 66 and 66*a*. The ON time or the OFF time is measured by the period measuring instrument 121 or 121*a*, that is, the one-fourth frequency divided signal Sg3 is delivered as a gate signal to the measuring instrument 121 or 121*a* to measure the period using reference clocks 122 or 122*a* in order to measure the period of rotation of the support shaft 26 or 21, respectively. Accordingly, measurement with a high degree of accuracy can be made in a short period of time during one full rotation of the rotor. While a method of counting the number of pulses using a rotor having a large number of teeth thereon is commonly used, a time sufficient for signals of 1000 pulses to be obtained is required in order to assure a high degree of accuracy, for example, the accuracy of 0.1% or so. Particularly where the rotational speed is low, much time is required. Besides, since each of the rotors has two teeth provided thereon, it has a good balance in rotation so that no trouble is caused if it is rotated at a high speed and no high degree of accuracy is required for working of the rotors.

Signals outputted via the input/output interface unit 104 of the control board 65 are delivered to a switching device 130. At the switching device 130, switching between the forward and reverse rotations of the control motor 58 is performed. In particular, an a contact 133 of a forward rotation line 131 and a b contact 136 of the other reverse rotation line 132 operate in an interlocking relationship, and a b contact 134 of the forward rotation line 131 and an a contact 135 of the reverse rotation line 132 operate in a similar interlocking relationship. Thus, when one of the lines is open, the other line is closed. Reference numeral 137 denotes a power source, and reference numeral 138 denotes a reduction gear.

Figure 6:
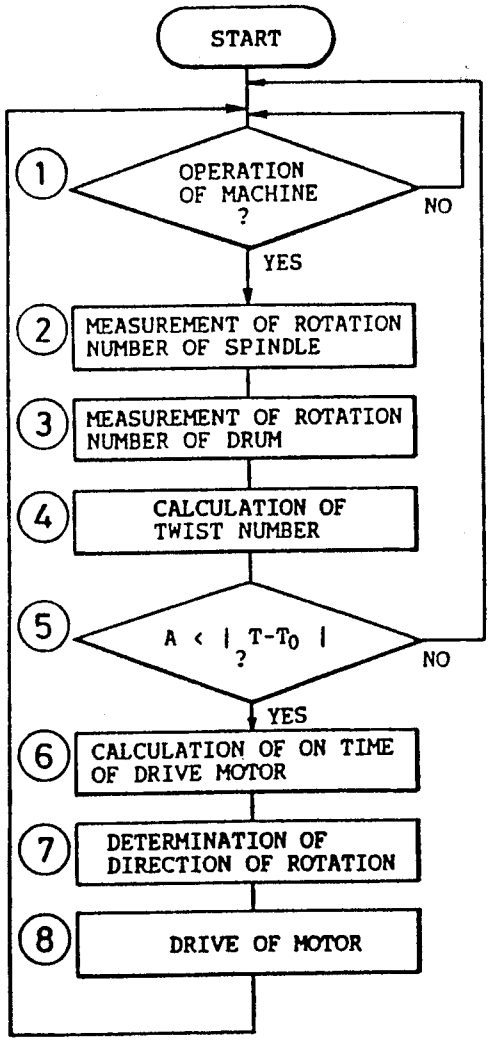

Control in the CPU 103 will now be described with reference to a block diagram of FIG. 6.

Step (1): Only during operation of the machine, control described below is executed.

Step (2): The period of rotation of the support shaft 21 of the first pulley 11 is measured, and the number of rotations of the pulley 11 is calculated from the measured value, whereafter the number of rotations is converted into the number of rotations of the spindles.

Step (3): The period of rotation of the support shaft 26 of the winding drums 6 is measured similarly, and the winding speed of yarn is calculated from the measured value.

Step (4): The number T of twists is calculated from the number of rotations of the spindles and the winding speed of yarn. Here, $$\text{Number of Twists} = \frac{2 \times \text{Spindle Rotations}}{\text{Yarn Winding Speed}}$$

Step (5): The difference between a set number To of twists inputted from the input board 64 and the measured number of twists, and the absolute value of the difference is compared with a tolerance value. When the absolute value exceeds the tolerance value, the sequence advances to YES, but on the contrary when the former does not exceed the latter, the sequence advances to NO.

Step (6): The ON time tm of the drive motor 58 is calculated from the $|T-To|$ value. The change gear ratio by the speed change belt device 50 changes depending upon the length of the ON time.

Step (7): The direction of rotation of the motor 58 is determined depending upon whether the $|T-To|$. value is positive or negative.

Step (8): The motor 58 is driven under the conditions calculated at the steps 6 and 7 above.

In this manner, only if an operator inputs a desired number of twists from the input board by operation of a keyboard, winding packages of the desired number of twists can be obtained.

As apparent from the foregoing description, according to the present invention, only if a desired number of twists is inputted from a keyboard for inputting, the number of twists can be attained, and the number of twists can be changed rapidly without requiring much time. Thus, a two-for-one twister can be obtained which can promptly cope with such multi-product small-quantity production as described at the beginning herein.

What is claimed is:

1. A twist number setting method for a two-for-one twister comprising the steps of:

inputting a desired number of twists into a control board;

driving a yarn supply spindle by means of a first support shaft at a first speed of rotation;

driving a drum by means of a second support shaft at a second speed of rotation, the first and second speeds of rotation defining a speed ratio;

supplying a turning force to a yarn winding package by contact with the drum;

detecting a period of a single rotation of at least one of the first and second support shafts using a reference clock signal, whereby the reference clock produces a predetermined number of signals over a fixed period of time and the period of a single rotation corresponds to a number of signals produced during the single rotation;

electronically controlling the driving of the yarn supply spindle and the driving of the drum in response to the number of signals produced during the single rotation;

changing the ratio between the first and second speeds of rotation to correspond to the desired number of twists.

2. A twist number setting method for a two-for-one twister according to claim 1, wherein the step of detecting the period of rotation of at least one of the first and second support shafts further comprises the steps of:

detecting rotation signals indicative of rotation of at least one of said first and second support shafts;

frequency dividing the detected rotation signals; and measuring the length of at least one of the frequency divided signals using at least one signal from a reference clock.

3. A twist number setting method for a two-for-one twister according to claim 2, wherein the step of frequency dividing the detected signals comprises frequency dividing the detected rotation signals using a one-fourth frequency divider.

4. A method for twisting yarn onto a yarn winding package comprising the steps of:

selecting a desired twist number;

driving a yarn supply spindle by means of a first support shaft at a first speed of rotation;

driving a drum by means of a second support shaft at a second speed of rotation so that there is a ratio between the first and second speeds of rotation;

supplying a turning force to the yarn winding package by contact with the drum;

detecting a period of a single rotation of at least one of the first and second support shafts using a reference clock signal, whereby the reference clock produces a predetermined number of signals over a fixed period of time and the period of a single rotation corresponds to a number of signals produced during the single rotation;

electronically determining a desired ratio between the first and second speeds of rotation based on the selected twist number;

controlling at least one of the first and second speeds of rotation in response to the number of signals produced during the single rotation;

whereby the ratio between the first and second speeds of rotation is varied to correspond to the desired ratio, thereby causing the yarn winding package to wind yarn having the desired number of twists.

5. A method for twisting yarn onto a yarn winding package as claimed in claim 4, wherein the step of selecting a desired twist number into a control board, wherein the desired relative ratio between the first and second speeds of rotation is calculated based on the inputted desired twist number.

6. A method for twisting yarn onto a yarn winding package according to claim 4, wherein the step of detecting the period of rotation of at least one of the first and second support shafts further comprises the steps of:

detecting rotation signals indicative of rotation of at least one of said first and second support shafts;

frequency dividing the detected rotation signals; and measuring the length of at least one of the frequency divided signals using at least one signal from a reference clock.

7. A method for twisting yarn onto a yarn winding package according to claim 6, wherein the step of frequency dividing the detected signals comprises frequency dividing the detected rotation signals using a one-fourth frequency divider.

* * * * *